US006621198B2

(12) United States Patent
Kanao et al.

(10) Patent No.: US 6,621,198 B2
(45) Date of Patent: Sep. 16, 2003

(54) SPARK PLUG HAVING IRIDUM ALLOY TIP, IRON-BASED ALLOY TIP BONDING PORTION AND STRESS RELIEVING LAYER THEREBETWEEN

(75) Inventors: Keiji Kanao, Chita-gun (JP); Seiki Nakagawa, Takahama (JP)

(73) Assignee: Denso Corporation, Kariya (JP)

( * ) Notice: Subject to any disclaimer, the term of this patent is extended or adjusted under 35 U.S.C. 154(b) by 21 days.

(21) Appl. No.: 09/761,835

(22) Filed: Jan. 18, 2001

(65) Prior Publication Data

US 2001/0013746 A1 Aug. 16, 2001

(51) Int. Cl.[7] ..... H01T 13/20

(52) U.S. Cl. ..... 313/141; 123/169 EL; 313/118; 313/144

(58) Field of Search ..... 313/141, 144, 313/145, 131 A, 130, 118; 123/169 R, 169 EL

(56) References Cited

U.S. PATENT DOCUMENTS

| | | | | | |
|---|---|---|---|---|---|
| 4,540,910 | A | * | 9/1985 | Kondo et al. | 313/141 |
| 4,670,684 | A | * | 6/1987 | Kagawa et al. | 313/141 |
| 4,853,582 | A | * | 8/1989 | Sato et al. | 313/144 |
| 4,881,913 | A | * | 11/1989 | Mann | 313/130 |
| 5,465,022 | A | * | 11/1995 | Katoh et al. | 313/144 |
| 5,488,262 | A | * | 1/1996 | Takamura | 313/141 |
| 6,307,307 | B1 | * | 10/2001 | Kanao | 313/118 |
| 6,346,766 | B1 | * | 2/2002 | Kanao et al. | 313/141 |

FOREIGN PATENT DOCUMENTS

| | | | |
|---|---|---|---|
| DE | 19922925 | A1 * | 11/1999 |
| DE | 19961768 | A1 * | 6/2000 |
| JP | 11-9665 | | 1/1999 |
| JP | 11329668 | | 11/1999 |
| JP | 11-329668 | * | 11/1999 |
| JP | 2000-277231 | * | 10/2000 |

* cited by examiner

*Primary Examiner*—Susan S. Y. Lee
(74) *Attorney, Agent, or Firm*—Nixon & Vanderhye P.C.

(57) ABSTRACT

A spark plug having a tip composed of an iridium alloy essentially consisting of iridium is resistance welded through a relieving layer to a front end of a center electrode having an iron-based alloy and a facing portion of a ground electrode and wherein the material of the relieving layer has a coefficient of linear expansion between the iridium alloy and the iron-based alloy and has a Young's modulus of elasticity smaller than that of the two alloys.

15 Claims, 7 Drawing Sheets

SPARK PLUG HAVING IRIDUM ALLOY TIP, IRON-BASED ALLOY TIP BONDING PORTION AND STRESS RELIEVING LAYER THEREBETWEEN

CROSS-REFERENCE TO RELATED APPLICATIONS

This application is based upon and claims priority from Japanese Patent Applications No. 2000-8738, filed Jan. 18, 2000 and No. 2000-385646 filed Dec. 19, 2000.

BACKGROUND OF THE INVENTION

1. Field of the Invention

The present invention relates to a spark plug provided inside a combustion chamber of an internal combustion engine and, more particularly, relates to an improvement of the bonding of an Ir alloy tip essentially consisting of iridium in a spark plug provided with such a tip at its ground electrode or center electrode.

2. Description of the Related Art

In recent years, to extend the plug service life and improve performance, a spark plug has been proposed, as disclosed in, for example, Japanese Unexamined Patent Publication (Kokai) No. 11-329668, comprising at the discharge gap an iridium tip comprised of an iridium alloy resistance welded as a spark discharge electrode member to a center electrode and/or ground electrode comprised of a nickel-based alloy essentially consisting of nickel.

Japanese Unexamined Patent Publication (Kokai) No. 11-329668 discloses to interpose, between the center electrode and/or ground electrode comprised of the nickel-based alloy and the iridium tip, a relieving layer comprised of a material having a coefficient of linear expansion in the range between the iridium tip and the nickel-based alloy and having a Young's modulus of elasticity smaller than the tip comprised of the iridium alloy and nickel-based alloy.

Summarizing the problems to be solved by the invention, even Japanese Unexamined Patent Publication (Kokai) No. 11-329668 cannot ensure sufficient bonding between the tip bonding portion of the center electrode and/or ground electrode and the iridium tip.

SUMMARY OF THE INVENTION

An object of the present invention is to provide a spark plug having a sufficient bonding force between a tip bonding portion of a center electrode and/or ground electrode and a tip comprised of an iridium alloy.

According to the present invention, there is provided a spark plug provided with a center electrode; an insulator shell holding the center electrode; a ground electrode fixed at the insulator shell and facing the center electrode across a discharge gap; a tip comprised of an iridium alloy essentially consisting of iridium bonded to the center electrode and/or the ground electrode at facing portions of the electrodes; and a stress relieving layer arranged between the tip and a tip bonding portion of the center electrode and/or ground electrode to which the tip is bonded; the tip bonding portion being comprised of an iron-based alloy; and the relieving layer being comprised of an alloy including platinum having a coefficient of linear expansion between that of the iridium alloy and the iron-based alloy and having a Young's modulus of elasticity smaller than the iridium alloy and the iron-based alloy.

Preferably, the tip bonding portion is comprised of an iron-based alloy containing at least 50 wt % of iron, still more preferably an iron-based alloy containing at least 50 wt % of iron and a balance of at least one of chromium and aluminum.

Preferably, the coefficient of linear expansion of the relieving layer at 900° C. is $9.2\times10^{-6}$ to $11.7\times10^{-6}$ (/° C.).

More preferably, the relieving layer contains at least 60 wt % of platinum.

Still more preferably, a Young's modulus of elasticity of the relieving layer at 900° C. is not more than $15\times10^{4}$ MPa and even more preferably at least $5\times10^{4}$ MPa.

Still more preferably, a thickness of the relieving layer is at least 0.2 mm and even more preferably not more than 0.6 mm.

Still more preferably, the tip contains at least 50 wt % of iridium and even more preferably contains at least 50 wt % of iridium and contains at least one of rhodium, platinum, ruthenium, palladium, and tungsten added to the iridium.

Preferably, the relieving layer is comprised of a first relieving layer arranged at the tip side and a second relieving layer arranged at the tip bonding portion, the coefficient of linear expansion of the first relieving layer is between the coefficient of linear expansion of the tip and the coefficient of linear expansion of the second relieving layer, and the coefficient of linear expansion of the second relieving layer is between the coefficient of linear expansion of the first relieving layer and the coefficient of linear expansion of the tip bonding portion.

Preferably, the tip is larger in outer circumference than the relieving layer.

BRIEF DESCRIPTION OF THE DRAWINGS

These and other objects and features of the present invention will be more apparent from the following description of the preferred embodiments given with reference to the accompanying drawings, wherein:

FIG. 2A is a schematic view of the state of the bonding interface in the initial state, while

FIG. 3A is a schematic view of the state of the bonding interface in the state after a durability test, while

FIGS. 9A is a partial sectional view of another embodiment of the present invention, while

DESCRIPTION OF THE PREFERRED EMBODIMENTS

The present inventors made an intensive study of the reasons why it is still not possible to obtain a sufficient bonding strength of the tip to the electrode with the configuration disclosed in Japanese Unexamined Patent Publication (Kokai) No. 11-329668.

Therefore, the inventors researched the state of separation of an iridium tip at a tip bonding portion of a ground electrode in the configuration of the spark plug disclosed in Japanese Unexamined Patent Publication (Kokai) No. 11-329668.

Figure 1:
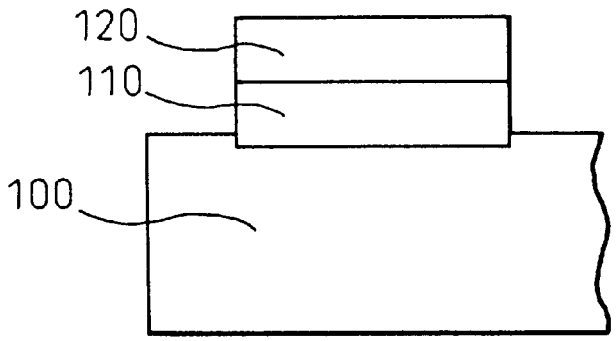
FIG. 1 is a partial enlarged view of a ground electrode of a related art.

The spark plug used, as shown in FIG. 1, is comprised of a ground electrode 100 made of a nickel-based alloy comprised of Ni-15 wt % Cr-7 wt % Fe to which is resistance welded an iridium alloy tip 120 comprised of Ir-10 wt % Rh through a relieving layer 110 comprised of Pt-20 wt % Ir-2 wt % Ni.

Further, as the durability test, use was made of an electric furnace heat-and-cool cycle test. A cycle of exposure to an environment of 900° C. for 1 minute, then to an environment of 20° C. for 1 minute was performed for 400 times or conditions corresponding to a target service life (100,000 km) in an engine durability test.

As the degree of separation, separation was judged at the point of time when the ratio of the portion separating at the entire interface between the ground electrode 100 and the relieving layer 110 and the ratio of the portion separating at the entire interface between the relieving layer 110 and the iridium tip 120 become at least 25 percent.

A total of 100 samples were subjected to a durability test. As a result, separation of the joint occurred at 26 samples. The number of samples suffering from separation is shown in Table 1.

TABLE 1

| Bonding location | Number of separations |
|---|---|
| Between iridium tip and relieving layer | 0 |
| Between relieving layer and ground electrode | 26 |

As shown in Table 1, no separation occurred at even one sample between the iridium tip 120 and the relieving layer 110, while separation occurred at 26 samples between the relieving layer 110 and the ground electrode 100.

Therefore, the inventors discovered that the main reason for the separation between the relieving layer 110 and the ground electrode 100 was the reduction in the bonding strength. Therefore, the inventors took note of the interface between the relieving layer 110 and the ground electrode 100 and elucidated the reasons for the separation. As a result, the inventors judged that the separation at the interface between the relieving layer 110 and the ground electrode 100 easily occurred.

The reasons will be explained in detail using FIG. 1.

FIG. 1, as explained above, shows a ground electrode 100 made of a nickel-based alloy to a tip bonding portion of which is resistance welded an iridium alloy tip 120 comprised of Ir-10 wt % Rh through a relieving layer 110 comprised of Pt-20 wt % Ir-2 wt % Ni.

Further, by making the composition of the relieving layer 110 as explained above, the coefficient of linear expansion of the relieving layer 110 becomes one in the range between the iridium tip 120 and the tip bonding portion and the Young's modulus of elasticity of the relieving layer 110 becomes smaller than that of the tip 120 comprised of an iridium alloy and the tip bonding portion.

Figure 2A:
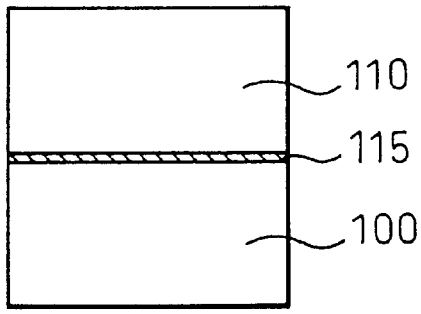
Figure 2B:
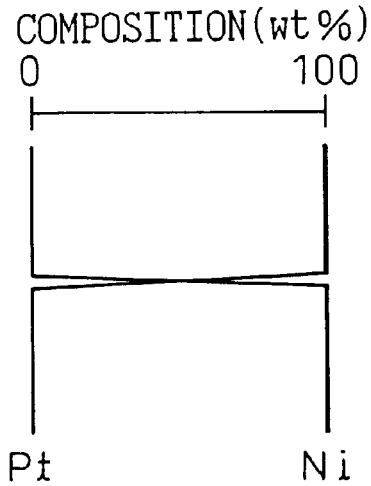
FIG. 2B is an explanatory view of the state of the bonding interface in the initial state.
Figure 3A:
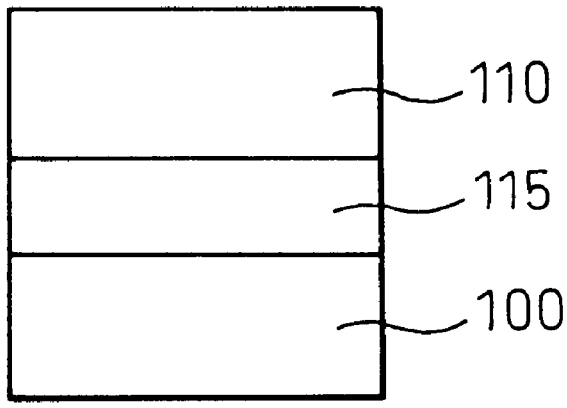
Figure 3B:
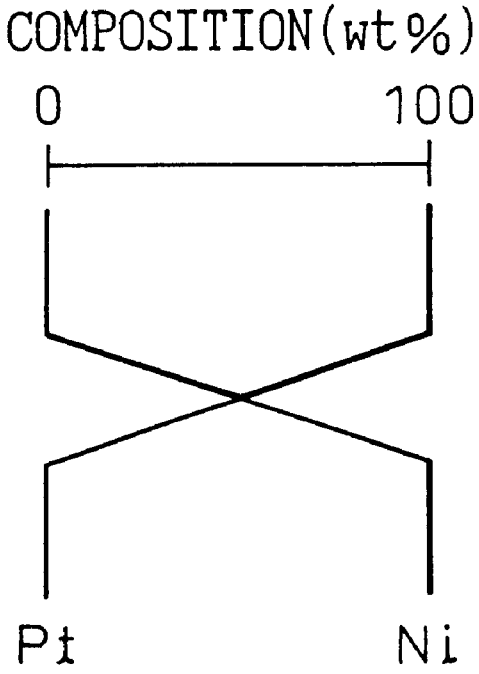
FIG. 3B is an explanatory view of the state of the bonding interface in the state after a durability test.

FIG. 2A is a schematic view of the state of the bonding interface in the initial state, while FIG. 2B is an explanatory view of the state of the bonding interface in the initial state. FIG. 3A is a schematic view of the state of the bonding interface in the state after a durability test, while FIG. 3B is an explanatory view of the state of the bonding interface in the state after a durability test.

As shown in FIG. 2A, a diffusion layer 115 of several microns thickness is formed at the interface between the relieving layer 110 and the ground electrode 100 in the initial case where the relieving layer 110 is resistance welded to the ground electrode 100. Therefore, the composition in the thickness direction of the diffusion layer 115 before the durability test, as shown in FIG. 2B, rapidly switches in ratios of platinum and nickel and therefore there is substantially no diffusion layer 115 present.

After the durability test, however, the thickness of the diffusion layer becomes greater. That is, the composition in the thickness direction in the diffusion layer 115 portion after the durability test, that is, after leaving the spark plug having the ground electrode 100 of FIG. 1 in an electric furnace at 900° C. for 5 hours, is shown in FIG. 3B.

As shown in FIG. 3A, after the durability test, the thickness of the diffusion layer 115 formed at the interface between the relieving layer 110 and the ground electrode 100 becomes a thickness of about 100 $\mu$m. The composition in the thickness direction exhibits a gentle change as shown in FIG. 3B. Therefore, in the diffusion layer 115, the alloying of the platinum component included in the relieving layer 110 and the nickel component included in the ground electrode progresses and two types of intermetallic compounds are formed by the nickel component and the platinum component.

The two types of intermetallic compounds are 23 wt % Ni-76 wt % Pt and 47.5 wt % Ni-52.5 wt % Pt. These intermetallic compounds do not have a coefficient of linear expansion and Young's modulus of elasticity according to the their compositions. Specifically, the coefficient of linear expansion of the intermetallic compounds is believed to be a value of about half of that of the iridium component. Further, the Young's modulus of elasticity of the intermetallic compounds is believed to be about double that of the iridium component.

Therefore, even if for example a relieving layer 110 is interposed, due to the production of intermetallic compounds having a small coefficient of linear expansion and a large Young's modulus of elasticity between the relieving layer 110 and the ground electrode 100, the relieving layer 110 and the ground electrode 100 easily end up separating.

In the present invention, the inventors took note of the above factors and selected a composition which would not form unpreferable intermetallic compounds between the relieving layer and the ground electrode.

As a result, as the composition of the tip bonding portion, they used an iron-based alloy having a coefficient of linear expansion and Young's modulus of elasticity about the same as a nickel-based alloy and not easily forming an intermetallic compound with a platinum component.

More specifically, in a first aspect of the invention, they used an iron-based alloy as the composition of the tip bonding portion and provided a relieving layer (61, 62)

comprised of an alloy containing platinum having a coefficient of linear expansion in a range between that of the iridium alloy and the iron-based alloy of the material comprising the tip bonding portion (3*a*, 4*a*) (hereinafter referred to as the "electrode material") and having a Young's modulus of elasticity smaller than the two alloys between the tip (51, 52) comprised of an iridium alloy essentially consisting of iridium and the tip bonding portion (3*a*, 4*a*).

In the present invention, by making the composition of the tip bonding portion an iron-based alloy rather than the conventional nickel-based alloy, only one type of intermetallic compound (22.24 wt % Fe-77.76 wt % Pt) is formed in the diffusion layer formed between the relieving layer (61, 62) and tip bonding portion. Therefore, compared with the related art, separation between the relieving layer and the tip bonding portion can be suppressed.

Further, the iron-based alloy forming the tip bonding portion becomes even closer to an iridium alloy in the coefficient of linear expansion compared with a nickel-based alloy comprising the conventionally known tip bonding portion. Therefore, by making the material comprising the tip bonding portion an iron-based alloy, it is possible to further improve the bond reliability of the tip comprised of the iridium alloy.

Further, an iron-based alloy is superior to a nickel-based alloy in heat resistance and oxidation resistance, so can be used even in an engine operating under a harsh heat load.

Still further, in the present invention, since the material comprising the relieving layer (61, 62) has a coefficient of linear expansion between that of the two alloys, it is possible to secure an action of relieving thermal stress at least equal to that of the past. Further, since it has a Young's modulus of elasticity smaller than that of the two alloys, it is possible to make the relieving layer (61, 62) softer and have the thermal stress of the bonding portion absorbed more efficiently. Therefore, due to the two effects, relief of the thermal stress of a higher level that the past becomes possible and the bonding of the tip can be improved.

Therefore, the tip bonding portion (3*a*, 4*b*) is preferably an iron-based alloy containing at least 50 wt % of iron.

By making the content at least 50 wt %, it is possible to make the coefficient of linear expansion of the tip bonding portion closer to the coefficient of linear expansion of the iridium tip and possible to suppress the separation of the iridium tip from the tip bonding portion.

Further, it is also possible to suppress the formation of a plurality of intermetallic compounds.

Further, the tip bonding portion (3*a*, 4*b*) preferably is comprised of an iron-based alloy containing at least 50 wt % of iron and a balance of at least one of chromium or aluminum.

Chromium and aluminum are extremely stable as oxides, so form dense chromium and aluminum oxide films on the surface of the electrode material in a high temperature atmosphere during the use of the engine and prevent the progress of oxidation to the inside, so the oxidation resistance at the tip bonding portion can be improved.

When making the tip bonding portion an iron-based alloy, the coefficient of linear expansion at 900° C. of the relieving layer (61, 62) is preferably $9.2\times10^{-5}$ to $11.7\times10^{-6}$ (/° C.).

This is because when the coefficient is smaller than $9.2\times10^{-6}$ (/° C.), separation easily occurs at the interface between the iridium tip and the relieving layer, while when the coefficient of linear expansion is larger than $11.7\times10^{-6}$ (/° C.), separation easily occurs at the interface between the tip bonding portion and the relieving layer.

Further, the relieving layer (61, 62) preferably contains at least 60 wt % of platinum.

By including at least 60 wt % of platinum in the relieving layer (61, 62), it is possible to bring the coefficient of linear expansion and Young's modulus of elasticity of the iridium tip to a preferable range.

When making the tip bonding portion an iron-based alloy, the Young's modulus of elasticity of the relieving layer (61, 62) at 900° C. is preferably not more than $15\times10^4$ MPa.

Further, the Young's modulus of elasticity of the relieving layer (61, 62) at 900° C. is preferably at least $5\times10^4$ MPa.

That is, when the Young's modulus of elasticity of the relieving layer at 900° C. is larger than $15\times10^4$ MPa, the relieving layer itself becomes too hard and it becomes no longer possible to sufficiently absorb the thermal stress at the bonding portion with the iridium tip or tip bonding portion. Further, when the Young's modulus of elasticity of the relieving layer at 900° C. is smaller than $5\times10^4$ MPa, the material forming the relieving layer becomes too soft and cracks are liable to form in the relieving layer itself rather than the bonding interface.

The thickness (t) of the relieving layer (61, 62) is preferably at least 0.2 mm.

Further, the thickness (t) of the relieving layer (61, 62) is preferably not more than 0.6 mm.

That is, when the thickness of the relieving layer is smaller than 0.2 mm, at the time of a durability test, cracks easily occur in the relieving layer itself. The thicker the relieving layer, the greater the effect of the relieving layer, but at a thickness larger than 0.6 mm, the effect of the relieving layer ends up becoming saturated, while if made thicker than 0.6 mm, the cost of the material only becomes greater.

A tip (51, 52) comprised of an iridium alloy essentially consisting of iridium, may be one containing at least 50 wt % of iridium or one containing at least 50 wt % of iridium and containing at least one of rhodium, platinum, ruthenium, palladium, and tungsten added to the iridium.

Further, the relieving layer (61, 62) is preferably comprised of a first relieving layer (61*a*, 62*a*) arranged at the tip (51, 52) side and a second relieving layer (61*b*, 62*b*) arranged at the tip bonding portion (3*a*, 4*b*) side, the coefficient of linear expansion of the first relieving layer (61*a*, 62*a*) is between the coefficient of linear expansion of the tip (51, 52) and the coefficient of linear expansion of the second relieving layer (61*b*, 62*b*), and the coefficient of linear expansion of the second relieving layer (61 *b*, 62*b*) is between the coefficient of linear expansion of the first relieving layer (61*a*, 62*a*) and the coefficient of linear expansion of the tip bonding portion (3*a*, 4*b*).

By adopting this configuration, it is possible to change the coefficient of linear expansion in steps between the iridium tip and the tip bonding portion and thereby possible to relieve the thermal stress in steps. Therefore, this is particularly effective when diameter of the tip is large. Here, as the first and second relieving layers, preferably use is made of a platinum-iridium alloy, platinum-nickel alloy, etc.

Further, in the invention set forth in claim 13, at the welded portion of the tip (51, 52) and the relieving layer (61, 62), the tip (51, 52) preferably has a larger outer circumference than the relieving layer (61, 62). By adopting this configuration, it is possible to improve the bonding since it is possible to reduce the thermal stress applied to the tip (51, 52) compared with the case where a relieving layer is welded to the entire surface of the tip in the welded portion.

Note that the reference numerals given in parentheses after the above means show the correspondence between the specific means of the embodiments described below. This present invention is not however limited by these.

Figure 4:
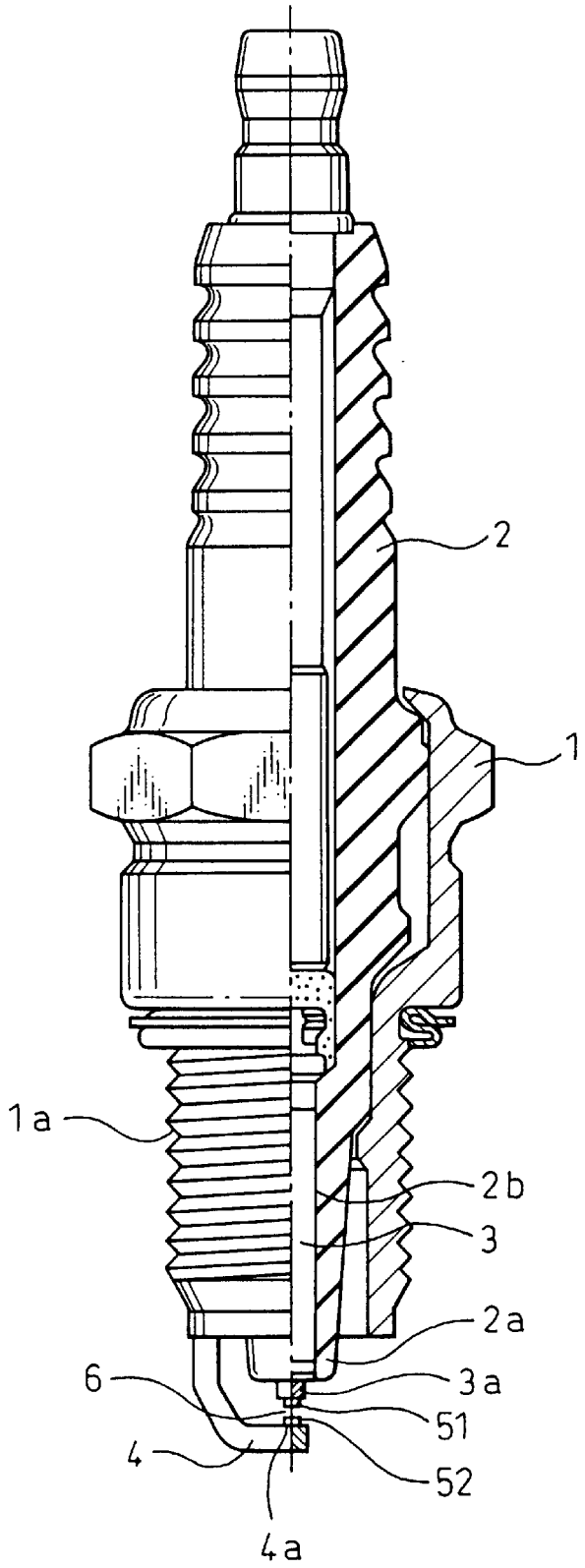
FIG. 4 is a semi sectional view of the overall configuration of a spark plug according to an embodiment of the present invention.

Next, an explanation will be made of embodiments illustrating the present invention. These embodiments are used as spark plugs of for example an internal combustion engine. FIG. 4 is a semi sectional view of the overall configuration of a spark plug of the present embodiment.

The spark plug has a cylindrically shaped shell 1. This shell 1 is provided with a threaded portion 1*a* for attachment to a not shown engine block. Inside of the insulator shell 1 is affixed an insulator 2 comprised of an alumina ceramic ($Al_2O_3$) etc. The front end 2*a* of the insulator 2 projects out from the shell 1.

The center electrode 3 is affixed to an axial hole 2*b* of the insulator 2 and is held insulated with respect to the shell 1 through the insulator 2. As shown in FIG. 1, the front end 3*a* of the center electrode 3 is provided so as to project from the front end 2*a* of the insulator 2. The center electrode 3 forms a cylindrical member comprised of copper or another metal material superior in heat conductivity as a not shown inside material and of an iron-based alloy or other metal material superior in heat resistance and corrosion resistance as an outside material.

The ground electrode 4 is welded to one end of the shell 1 and is bent into a substantial L-shape in the middle. At the tip bonding portion opposite to the welded portion, that is, the facing portion 4*a,* it faces the front end 3*a* of the center electrode 3 across a discharge gap 6. The ground electrode 4 is comprised by a metal material superior in heat resistance and corrosion resistance. Here, FIG. 5 is an enlarged view of the facing portions of the two electrodes 3 and 4 in FIG. 4.

Figure 5:
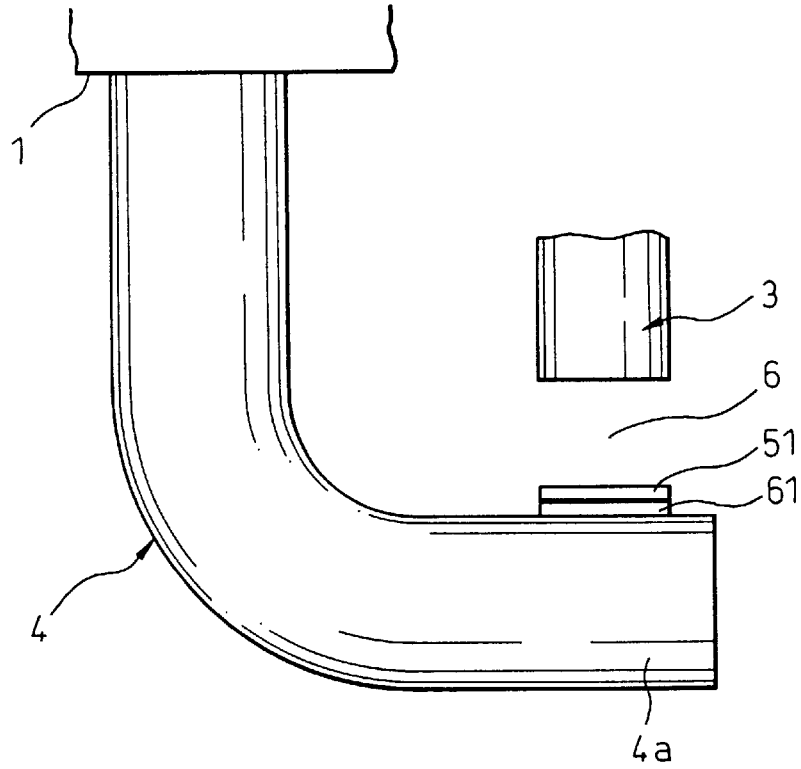
FIG. 5 is an enlarged view of facing portions of a center electrode and ground electrode in FIG. 4.
Figure 6:
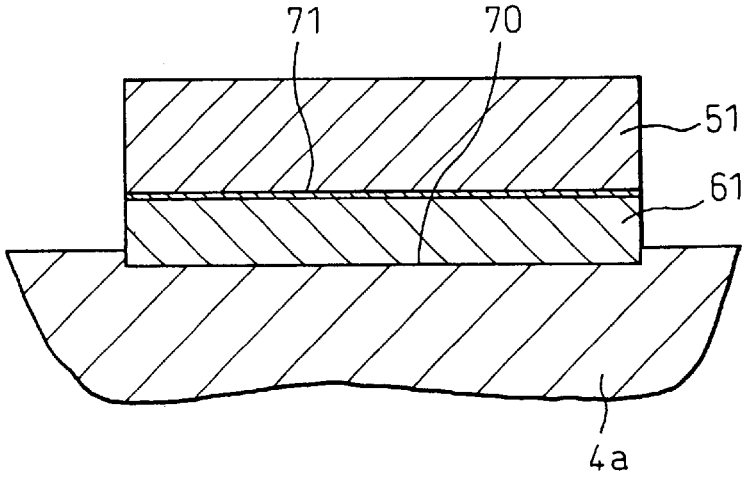
FIG. 6 is a sectional view of a tip bonding portion in FIG. 5.

As shown in FIG. 5, an iridium tip (discharge layer) 51 comprised of an iridium alloy (in the present example, 90 wt % Ir-10 wt % Rh) is resistance welded to the portion 4*a* of the ground electrode 4 facing the center electrode 3 through a relieving layer 61. Here, FIG. 6 is a sectional view of the bonding portion of the tip 51.

The tip 51 is shaped as a disk of for example a diameter of 1.0 mm and a thickness of 0.3 mm. A discharge gap 6 is formed by the space between the center electrode 3 and the tip 51 (for example, about 1 mm). Further, the relieving layer 61 is a disk-shaped layer having a diameter the same as the tip 51 (for example, 1.0 mm) and a thickness of 0.4 mm. Here, the tip bonding portion, that is, the facing portion 4*a,* is comprised of an iron-based alloy. In this example, it is an Fe-15 wt % Cr-4 wt % Al alloy.

In the present embodiment, further, the material comprising the relieving layer 61 is made one having a coefficient of linear expansion $\alpha$ one of a range between the iridium alloy of the material comprising the tip 51 and the iron-based alloy of the electrode material comprising the facing portion 4*a* and having a Young's modulus of elasticity E smaller than the iridium alloy and iron-based alloy. Various experiments and studies were conducted relating to the material comprising the relieving layer 61. The invention was made based on the findings.

Specific values are shown in Table 2.

TABLE 2

| | Coefficient of linear expansion (/° C.) | Young's modulus of elasticity (MPa) |
|---|---|---|
| Iridium tip 51 | $7.8 \times 10^{-6}$ | $38 \times 10^4$ |
| Relieving layer 61 | $10.5 \times 10^{-6}$ | $10.8 \times 10^4$ |
| Facing portion 4a | $13.8 \times 10^{-6}$ | $15 \times 10^4$ |

Figure 7:
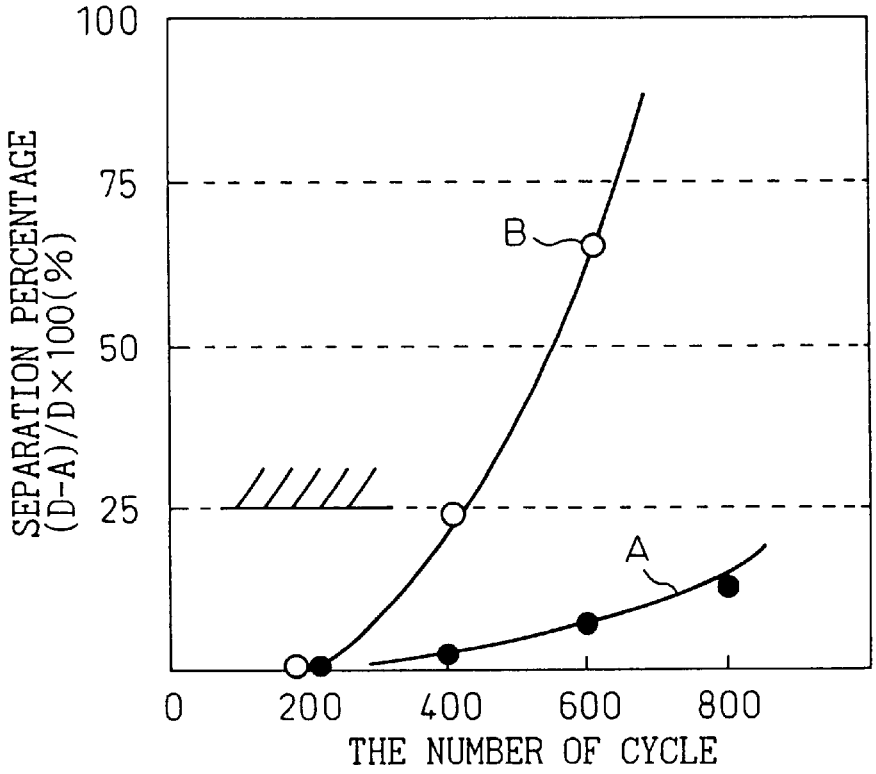
FIG. 7 is a view of the relationship between the number of cycles and rate of separation in the related art and the present invention.

Next, the results of the degree of separation of the ground electrode and the relieving layer due to a durability test are shown in FIG. 7 for a spark plug 1 of the above configuration and a spark plug of the configuration of the related art, that is, one having an iridium tip comprised of Ir-10 wt % Rh resistance welded through a relieving layer comprised of Pt-20 wt % Ir-2 wt % Ni to a ground electrode comprised of Iconel (registered trademark), one type of a nickel-based alloy.

Here, A shows a spark plug using an iron-based alloy for the facing portion 4*a* of this example, while B shows a spark plug using a nickel-based alloy of the related art.

Figure 8:
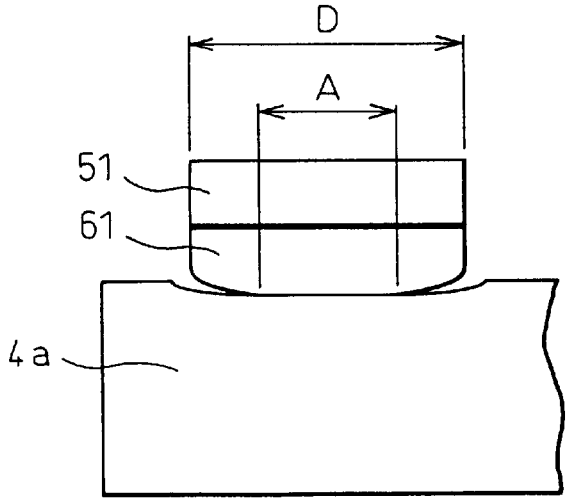
FIG. 8 is an explanatory view of the rate of separation.

As the standard for evaluation in the durability test, as shown in FIG. 8, the rate of separation ((D−A)/D×100) was found at the interface between the ground electrode 4 and the relieving layer 61 using the length in the diametrical direction of the relieving layer 61 as D and the length in the diametrical direction reliably bonded in the length in the diametrical direction of the relieving layer D as A. Further, during engine use, the possibility of separation and detachment due to the combustion pressure, vibration, and other work stress becomes larger, so the sample was evaluated as defective when the rate of separation was more than 25 percent.

As the durability test, use was made of an electric furnace heat-and-cool cycle test. A cycle consisted of exposure to an environment of 900° C. for 1 minute, then to an environment of 20° C. for 1 minute. The relationship between the number of cycles and rate of separation is shown in FIG. 6.

As clear from FIG. 7, it can be easily understood that a spark plug having a ground electrode comprised of an iron-based alloy of the present embodiment is much more resistant to separation than the related art.

As the reason for this, it is possible to obtain a unique effect by the iron-based alloy of suppressing the production of an intermetallic compound compared with a combination of a nickel-based alloy and platinum even if the diffusion layer formed at the bonding interface between the facing portion 4*a* of the ground electrode 4 and the relieving layer 61 becomes thicker after the durability test. By improving the bond reliability due to the employment of an iron-based alloy, a great increase in the plug replacement time becomes possible and the service life of the plug can be extended. Further, bonding with inexpensive resistance welding becomes possible and it is possible to obtain a low cost and high reliability plug having an iridium alloy tip. Further, the present embodiment is suitable for use for a spark plug used in a further tougher heat load environment.

In the above embodiment, resistance welding was performed twice, that is, the resistance welding of the relieving layer 61 to the tip bonding portion 4*a* and the resistance welding of the tip 51, but as another embodiment, it is also possible to perform resistance welding once of a cladding type tip comprised of a tip 51 and relieving layer 61 bonded together in advance.

Further, if the tip diameter becomes large, that is, if the area of the interface between the tip and the relieving layer and the area of the interface of the relieving layer and the tip bonding portion become larger, the thermal stress applied also becomes larger.

Figure 9A:
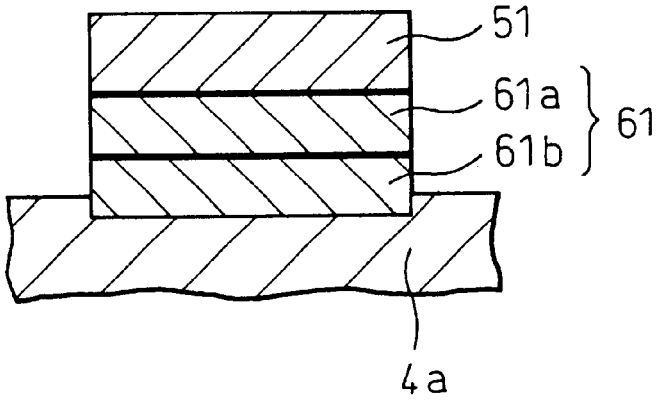
Figure 9B:
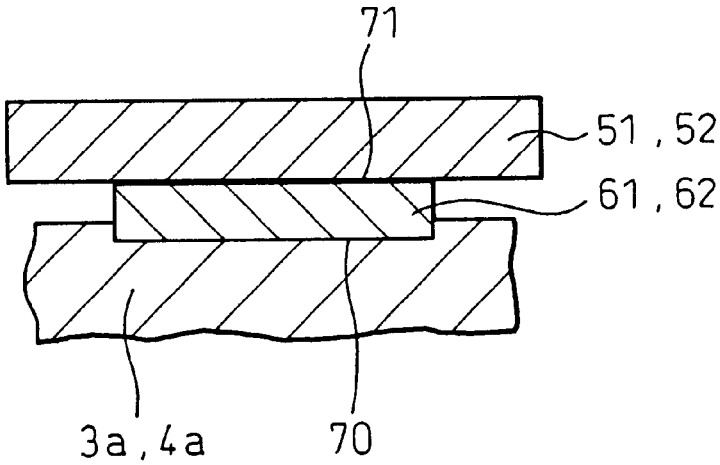
FIG. 9B is a partial sectional view of another embodiment of the present invention.

Therefore, a configuration corresponding to the increase in the tip diameter is shown in FIGS. 9A and 9B. In FIG. 9A, the relieving layer 61 is made a two-layer structure of a first relieving layer 61*a* arranged at the tip 51 side and a second relieving layer 61*b* arranged between the first relieving layer 61*a* and the tip bonding portion 4*a*.

In this case, it is possible to change the coefficient of linear expansion in steps between the tip 51 and the tip bonding portion 4*a* compared with the case of a single relieving layer 61 and, due to this, possible to relieve the thermal stress in steps as well. Therefore, the configuration of FIG. 9A is effective when the diameter of the tip is large (for example, at least 1.5 mm). For example, it is possible to use a platinum-iridium alloy as the first relieving layer and a platinum-iron alloy as a second relieving layer.

Further, in FIG. 9B, in the tip-relieving layer bonding face 71, if bonding a tip 51 larger in outer circumference than the relieving layer 61, that is, a tip 51 larger than the relieving layer 61, it is possible to secure bonding and greatly improve the consumption resistance. By making the diameter of the relieving layer 61 smaller than the tip diameter, even if the tip diameter is large, the thermal stress applied to the interface can be made smaller.

Note that the discharge layer member, that is, the tip 51, and the relieving layer 61 may also be configured as a rod shape and a rectangular shape in addition to a disk shape.

In the above embodiment, the explanation was made of the configuration making the ground electrode out of an iron-based alloy and resistance welding the iridium tip to the ground electrode comprised of this iron-based alloy. The present invention, however, is not limited to the ground electrode. In the center electrode comprised of the iron-based alloy, it is also possible to resistance weld the iridium tip by the above configuration to the portion of the center electrode facing the ground electrode.

Here, a preferable coefficient of linear expansion of the relieving layer in the case of making the tip bonding portion in the present invention an iron-based alloy will be considered.

Figure 10:
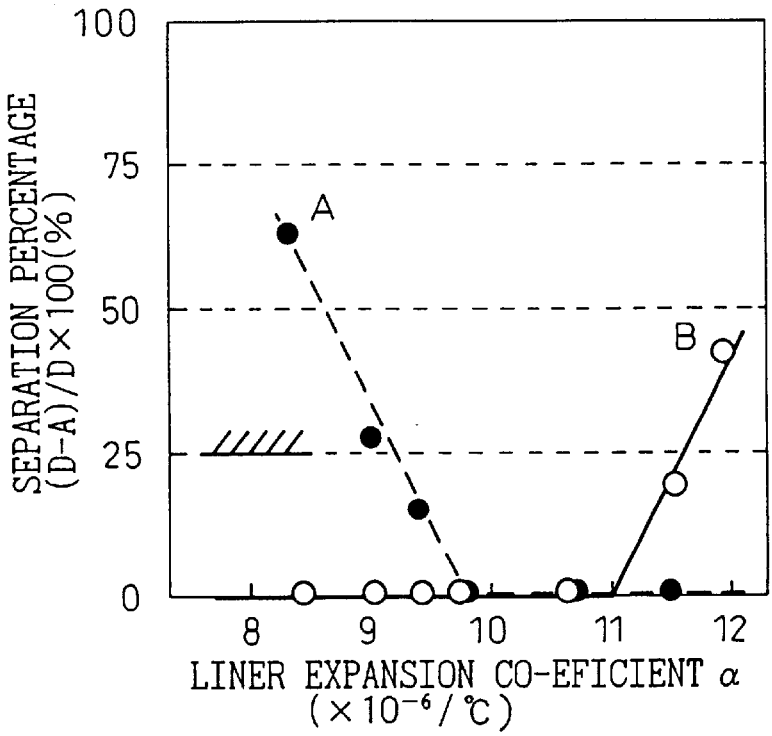
FIG. 10 is a view of the relationship of the coefficient of linear expansion and the rate of separation of the relieving layer at the interface.

FIG. 10 shows the rate of separation of the interface A between the iridium tip 51 and the relieving layer 200 and the rate of separation of the interface B between the facing portion 4*a* of the tip bonding portion of the ground electrode and the relieving layer 200 in the case of changing the linear expansion of the relieving layer 200.

Here, the facing portion 4*a* of the ground electrode 4 and the iridium tip 51 are made using the same material as the first embodiment. Further, the relieving layer 200 is changed in coefficient of linear expansion by changing the platinum content to at least 60 wt %, the iridium to 10 to 40 wt %, the nickel to 0 to 5 wt %, and the iron to 10 to 20 wt %.

Figure 11:
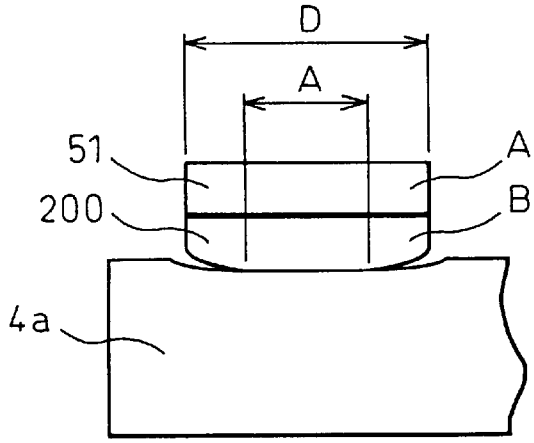
FIG. 11 is a partial enlarged view of a spark plug finding the relationship of FIG. 10.

Here, the condition of the rate of separation was made the same as the condition of FIG. 7 and the defect rate was made at least 25 percent. Further, the method shown in FIG. 11 was used to find the rate of separation.

As clear from FIG. 10, when the coefficient of linear expansion of the relieving layer 200 is not more than $9\times10^{-6}$/° C., the rate of separation becomes at least 25 percent at the interface B between the facing portion 4*a* of the tip bonding portion of the ground electrode 4 and the relieving layer 200. When the coefficient of linear expansion becomes more than $11.7\times10^{-6}$/° C., the rate of separation of the interface A between the iridium tip 51 and the relieving layer 2000 becomes at least 25 percent.

The reason is that when the coefficient of linear expansion of the relieving layer 200 is not more than $9.2\times10^{-6}$/° C., the coefficient of linear expansion between the relieving layer 200 and the facing portion 4*a* ends up becoming large and separation ends up easily occurring. Further, this is believed due to the fact that when the coefficient of linear expansion of the relieving layer 200 is more than $1.7\times10^{-6}$/° C., the coefficient of linear expansion of the relieving layer 200 and the iridium tip 51 ends up becoming large and separation ends up easily occurring.

The preferable Young's modulus of elasticity and thickness of the relieving layer was confirmed to not be dependent on the composition of the tip bonding portion.

While the invention has been described by reference to specific embodiments chosen for purposes of illustration, it should be apparent that numerous modifications could be made thereto by those skilled in the art without departing from the basic concept and scope of the invention.

What is claimed is:

1. A spark plug comprising:

a center electrode;

an insulator shell holding the center electrode;

a ground electrode fixed at the insulator shell and facing the center electrode across a discharge gap;

a tip comprised of an iridium alloy essentially consisting of iridium bonded to at least one of said center electrode and said ground electrode at facing portions of said electrodes; and a stress relieving layer arranged between the tip and a tip bonding portion of the at least one of the center electrode and ground electrode to which the tip is bonded, wherein the tip bonding portion is comprised of an iron-based alloy, and the relieving layer is comprised of an alloy including platinum having a coefficient of linear expansion between that of the iridium alloy and said iron-based alloy and having a Young's modulus of elasticity smaller than said iridium alloy and said iron-based alloy.

2. The spark plug of claim 1, wherein said tip bonding portion is comprised of an iron-based alloy containing at least 50 wt % of iron.

3. The spark plug of claim 1, wherein said tip bonding portion is comprised of an iron-based alloy containing at least 50 wt % of iron and a balance of at least one of chromium and aluminum.

4. The spark plug of claim 1, wherein the coefficient of linear expansion of said relieving layer at 900° C. is $9.2\times10^{-6}$ to $11.7\times10^{-6}$ (/° C.).

5. The spark plug of claim 1, wherein said relieving layer contains at least 60 wt % of platinum.

6. The spark plug of claim 1, wherein a Young's modulus of elasticity of said relieving layer at 900° C. is not more than $15\times10^{4}$ MPa.

7. The spark plug of claim 1, wherein a Young's modulus of elasticity of said relieving layer is at least $5\times10^{4}$ MPa.

8. The spark plug of claim 1, wherein a thickness of said relieving layer is at least 0.2 mm.

9. The spark plug of claim 1, wherein a thickness of said relieving layer is not more than 0.6 mm.

10. The spark plug of claim 1, wherein said tip contains at least 50 wt % of iridium.

11. The spark plug of claim 1, wherein said tip contains at least 50 wt % of iridium and contains at least one of rhodium, platinum, ruthenium, palladium, and tungsten added to said iridium.

12. The spark plug of claim 1, wherein said relieving layer is comprised of a first relieving layer arranged at said tip side and a second relieving layer arranged at said tip bonding portion, a coefficient of linear expansion of said first relieving layer is between a coefficient of linear expansion of said tip and a coefficient of linear expansion of said second relieving layer, and the coefficient of linear expansion of the second relieving layer is between the coefficient of linear expansion of said first relieving layer and the coefficient of linear expansion of said tip bonding portion.

13. The spark plug of claim 1, wherein said tip is larger in outer circumference than said relieving layer.

14. A spark plug according to claim 1, wherein a diffusion layer formed between the stress relieving layer and the tip bonding portion contains only one intermetallic compound.

15. A spark plug according to claim 14, wherein the intermetallic compound comprises of 22.24 wt % Fe-77.76 wt % Pt.

* * * * *